US011680584B2

(12) United States Patent
Haag et al.

(10) Patent No.: US 11,680,584 B2
(45) Date of Patent: Jun. 20, 2023

(54) FAN HAVING AN EXTERNAL ROTOR MOTOR AND COOLING DUCT FOR COOLING THE MOTOR ELECTRONICS AND MOTOR DRIVE COMPONENTS

(71) Applicant: ebm-papst Mulfingen GmbH & Co. KG, Mulfingen (DE)

(72) Inventors: Christian Haag, Künzelsau (DE); Tobias Schmidt, Ahorn-Schillingsstadt (DE); Wolfgang Buerckert, Bad Mergentheim (DE)

(73) Assignee: ebm-papst Mulfingen GmbH & Co. KG, Mulfingen (DE)

( * ) Notice: Subject to any disclaimer, the term of this patent is extended or adjusted under 35 U.S.C. 154(b) by 163 days.

(21) Appl. No.: 17/146,654

(22) Filed: Jan. 12, 2021

(65) Prior Publication Data

US 2021/0222704 A1 Jul. 22, 2021

(30) Foreign Application Priority Data

Jan. 16, 2020 (DE) ..... 10 2020 100 865.1

(51) Int. Cl.
*F04D 29/58* (2006.01)
*F04D 25/06* (2006.01)
*F04D 29/056* (2006.01)

(52) U.S. Cl.
CPC ..... *F04D 29/584* (2013.01); *F04D 25/064* (2013.01); *F04D 25/0613* (2013.01); (Continued)

(58) Field of Classification Search
CPC ..... F04D 25/0613; F04D 25/0626; F04D 29/582; F04D 29/584; F04D 29/5806; (Continued)

(56) References Cited

U.S. PATENT DOCUMENTS 6,107,708 A 8/2000 Yamaguchi et al.
9,531,239 B2 * 12/2016 Maschke ..... H02K 11/33
2017/0288507 A1 10/2017 Otsuka et al.

FOREIGN PATENT DOCUMENTS

DE 102010046672 A1 3/2012
DE 102015105188 A1 * 10/2016 ..... F04D 13/0646
(Continued)

OTHER PUBLICATIONS

Hashi, Brushless Motor—"WO0227895AMT.pdf-DES", (Sep. 2001) (Year: 2001).*

(Continued)

*Primary Examiner* — Kenneth J Hansen
(74) *Attorney, Agent, or Firm* — Harness, Dickey & Pierce, P.L.C.

(57) ABSTRACT

A fan has an external rotor motor with a motor section and an electronics section. The motor section and the electronics section are arranged axially adjacent to each other along the axis of rotation. The fan, when operated as intended, generates, via the fan wheel, a pressure difference between its suction side, which is preferably associated with the rotor, and its pressure side, which is preferably associated with the motor electronics. A continuous cooling duct runs within the external rotor motor from a pressure-side inflow opening, at least along sections of the rotor, to a suction-side outflow opening. An exclusively passive cooling air flow through the cooling duct can be generated in operation by the pressure difference generated by the fan wheel.

15 Claims, 5 Drawing Sheets

(52) U.S. Cl.
CPC ..... *F04D 25/0646* (2013.01); *F04D 29/056* (2013.01); *F04D 29/5806* (2013.01); *F04D 29/5813* (2013.01)

(58) Field of Classification Search
CPC ..... F04D 29/5813; H02K 5/207; H02K 9/14; H02K 9/227; H02K 1/32
See application file for complete search history.

(56) References Cited

FOREIGN PATENT DOCUMENTS

| | | | | |
|---|---|---|---|---|
| WO | WO-02/27895 | A1 | 4/2002 | |
| WO | WO-0227895 | A1 * | 4/2002 | ..... F04D 25/082 |
| WO | WO-2008/146154 | A2 | 12/2008 | |

OTHER PUBLICATIONS

Pfaff, Electric Motor With Pressing Cooling Air Conveying . . .—"DE_102015105188_A1_I_MT", (Jun. 2016) (Year: 2016).*

European Search Report dated May 17, 2021 in corresponding European Application No. 21151059.

* cited by examiner

FAN HAVING AN EXTERNAL ROTOR MOTOR AND COOLING DUCT FOR COOLING THE MOTOR ELECTRONICS AND MOTOR DRIVE COMPONENTS

CROSS-REFERENCE TO RELATED APPLICATION

This application claims priority to German Application No. 10 2020 100 865.1, filed Jan. 16, 2020. The disclosure of the above application is incorporating herein by reference.

FIELD

The disclosure relates to a fan having an external rotor motor and a cooling duct for cooling both the motor electronics and motor drive components.

BACKGROUND

Heat generation in electric motors plays a critical part in obtainable power and service life. Therefore, action to cool the motor electronics has been taken in the prior art, particularly, an active chill wheel is used in one variant in addition to the fan wheel driven by the external rotor motor. The chill wheel generates its own cooling air flow when the rotor is rotating. The flow is actively conducted along the motor electronics. If external rotor motors are used at low speeds, the cooling capacity of the active chill wheel is often insufficient to ensure adequate heat dissipation. Other disadvantages of active chill wheels include that they generate noise at high speeds, that they can be dependent on the direction of rotation, and that they have a need for additional torque, which reduces efficiency.

In other solutions, the surface area of the adjacent components or the material used is increased, resulting in greater wall thickness of the electronics housing to absorb more heat. This increases the weight. Alternatively, materials with a higher heat conductivity are used, but such materials are expensive.

In addition to cooling the motor electronics, it is also desirable to cool the rotor, the stator, or the motor bearings.

It is therefore an underlying problem of the disclosure to provide a fan that improves cooling of the entire arrangement of the external rotor motor with respect to its motor electronics and motor drive components even at low speeds. Also required is to accomplish this with as little and as low-cost material as possible. In addition, noise generation should be relatively low.

SUMMARY

This problem is solved by the combination of features according to a fan having an external rotor motor comprising a rotor rotating about an axis of rotation in a motor section and configured to receive a fan wheel in an outwardly enclosing manner. Motor electronics are arranged in an electronic section and housed in an electronics housing. The motor section and the electronics section are arranged axially or radially adjacent to each other along the axis of rotation. The fan generates a pressure difference ($\Delta p$) between its suction side and its pressure side by the fan wheel. A continuous cooling duct runs inside the external rotor motor from a flow opening at the electronics housing along the motor electronics and at least along sections of the rotor to a flow opening in the motor section. Thus, an exclusively passive cooling air flow through the cooling duct can be generated in operation due to the pressure difference ($\Delta p$) generated by the fan wheel to cool both the electronics section and the motor section.

According to the disclosure, a fan with an external rotor motor is proposed. The external rotor motor comprises a rotor rotating about an axis of rotation in a motor section. The rotor is configured to receive a fan wheel by enclosing it radially on the outside. The external rotor motor further includes motor electronics received in an electronics housing in an electronics section. The motor section and the electronics section are preferably arranged axially, alternatively radially, next to each other along the axis of rotation. When operated as intended, the fan wheel of the fan generates a pressure difference between its suction side, which preferably is associated with the rotor, and its pressure side, which preferably is associated with the motor electronics. A continuous cooling duct runs within the external rotor motor from a pressure-side inflow opening at the electronics housing along the motor electronics and at least along sections of the rotor to a suction-side outflow opening in the motor section. Thus, in operation, an exclusively passive cooling air flow through the cooling duct can be generated by the pressure difference generated by the fan wheel in order to cool both the electronics section and the motor section.

In principle, the pressure side and the suction side depend on the flow direction of the fan. But the cooling air always flows from the pressure side to the suction side. The inflow opening at the electronics housing described above then is the outflow opening in an inverse flow direction, while the outflow opening in the motor section becomes the inflow opening.

When the fan is in operation, the fan wheel takes in air on the suction side, thus creating a negative pressure on the suction side. It blows out the air on the pressure side, where a positive pressure occurs. This results in a pressure difference $\Delta p$ between the suction side and the pressure side. The pressure difference causes a compensation flow through the cooling duct, which is used as a passive cooling air flow. In the present solution, the cooling air flow is therefore taken in on the suction side and delivered through the cooling duct. The pressure difference is generated by the fan wheel on the intake side of the fan. By suctioning in the cooling air flow on the pressure side and discharging the cooling air flow on the suction side at the rotor, the motor electronics in the electronics section and the motor drive components in the motor section are cooled as a whole. Thus, the entire arrangement of the external rotor motor with its motor parts and its electronics is cooled. Cooling can therefore either increase the performance or even allow installation of a smaller motor, depending on the application. This saves costs.

A "passively" generated cooling air flow through the cooling duct is in this case defined as differing from an airflow generated by an active chill wheel that rotates in operation, which is an active air flow. Active chill wheels generate noise, particularly at higher speeds. This can be prevented by a purely passive cooling system.

An axial section where the components of the motor electronics end that project farthest towards the rotor is used as a separation between the electronics section and the motor section. The motor electronics is often also axially placed upon the motor drive components. The separation then results from the two components.

In one embodiment, cooling capacity is improved where multiple cooling fins are formed on the electronics housing that extend axially and radially into the cooling duct starting from the inflow opening and form a duct wall surface of the cooling duct. The cooling fins preferably also form the inflow opening at the electronics housing. The surface area increase achieved by the cooling fins and positioning directly at the inflow opening result in favorable and effective heat dissipation via the cooling air flow through the cooling duct.

The fan is further preferably characterized in that the rotor has a rotor housing, preferably formed as a rotor bell. The outflow opening is formed in the region of the axial end face of the rotor housing. The outflow is thus preferably axial, but it can also be provided on the shell surface of the rotor housing or at the transition between the axial end face and the shell surface and thus have at least a partially radial outflow direction.

Radial fans often do not have openings at the rotor or rotor housing, respectively. Therefore, the fan wheel for this embodiment has an impeller base plate with impeller blades formed thereon, wherein the outflow opening is formed in the impeller base plate. The cooling duct therefore does not extend from the motor section over the entire axial length but is guided outside the rotor as early as at the impeller base plate.

In a preferred embodiment, the external rotor motor has, in the motor section, a stator bushing with a stator pack and motor windings as well as stator cooling fins that are distributed in the peripheral direction. The cooling duct also runs along the stator cooling fins.

In the solution for radial fans, the impeller base plate axially runs adjacent to the stator cooling fins that extend axially to the impeller base plate. Thus, the cooling air flow can be conducted axially via the stator cooling fins to the outflow opening in the impeller base plate. In this solution, sufficient cooling capacity in the motor section is ensured in addition to the cooling of the motor electronics in radial fans as well, since the stator cooling fins as a motor component are arranged in the motor section.

In an embodiment of axial fans and diagonal fans, the external rotor motor has, in the motor section, a stator bushing with a stator pack and motor windings as well as stator cooling fins that are distributed in the peripheral direction. The cooling air flow also runs along the stator pack directly adjacent to the stator cooling fins. The cooling air flow can freely flow through the motor section along the path of lowest resistance or be conducted in a cooling duct along specific components. Due to the option to form the outflow opening at the rotor or rotor housing itself, the cooling air flow can be conducted directly past the components in the interior of the rotor that heat up during operation.

In a favorable exemplary embodiment of the fan, the cooling duct is closed or substantially closed at a transition from the electronics section to the motor section by a standing or rotatable cover. Substantially closed means that no complete cover is provided. The cover can have a labyrinth shape like a labyrinth seal to have as low leakage losses as possible. The cover can be standing or rotating in operation, depending on which component it is fastened. Thus, it is attached to the electronics housing or the rotor. The cover thus forms an outer shell surface of the external rotor motor.

In a further development of the fan, the cooling duct has multiple changes of direction in its course from the inflow opening to the outflow opening. Thus, the cooling air flow is diverted multiple times. In this manner, the cooling can be conducted along the components to be cooled and the cooling capacity can be increased.

The outflow opening at the rotor housing is at an axial spacing from the fan wheel. This favorably ensures a sufficient pressure difference and thus the suction effect at the outflow opening.

In a further embodiment of the fan, the cooling duct extends in the electronics section and the motor section in a locally limited manner in the peripheral direction. This limits the space needed for cooling. The design of the external rotor motor remains compact.

In a further development of the fan, the rotor is supported by at least one bearing. The cooling duct is conducted past the at least one bearing. The bearing support also produces heat which is preferably removed by the cooling air flow as well.

The disclosure further includes an embodiment of the fan with an external rotor motor with a rotor rotating about an axis of rotation in a motor section configured to receive and radially enclose a fan wheel and with motor electronics arranged in an electronics section. The motor section and the electronics section are arranged axially along the axis of rotation or radially adjacent to each other relative to the axis of rotation. The external rotor motor has in its motor section, a stator bushing with a stator pack and motor windings as well as stator cooling fins distributed about the periphery of the stator. When operated as intended, the fan generates a pressure difference $\Delta p$ between its suction side and its pressure side by the fan wheel. A continuous cooling duct runs inside the external rotor motor along the stator cooling fins from a pressure-side inflow opening to a suction-side outflow opening. In operation, an exclusively passive cooling air flow through the cooling duct can be generated by the pressure difference ($\Delta p$) generated by the fan wheel. At least one power module of the motor electronics is arranged directly adjacent to the stator bushing with the stator cooling fins in order to remove heat from, or cool, the motor section and at least the power module, but also other components of the motor electronics via the stator bushing.

All features described above can also be directly applied to this fan as far as technologically feasible. Particularly, the cooling air flow also depends on the flow direction of the fan. Once again, both variants are covered, that is, the flow through the flow opening in the impeller base plate and thus a cooling air flow outside the rotor housing (rotor bell), or flow through the flow opening on the end face of the rotor bell and thus a cooling air flow inside the rotor bell along the motor components, such as the stator windings.

Other advantageous refinements of the disclosure are characterized in the dependent claims and will be described in greater detail in the following in conjunction with the description of the preferred embodiment of the disclosure, with reference to the figures.

DRAWINGS

Embodiment examples of the disclosure are described below in reference to the drawings. The disclosure is not limited to these embodiment examples. The drawings, in reference to figures, shows the basic design of the present, namely:

DETAILED DESCRIPTION

The figures are schematic for illustration. Like reference numbers in the figures indicate like functional and/or structural features.

Figure 1:
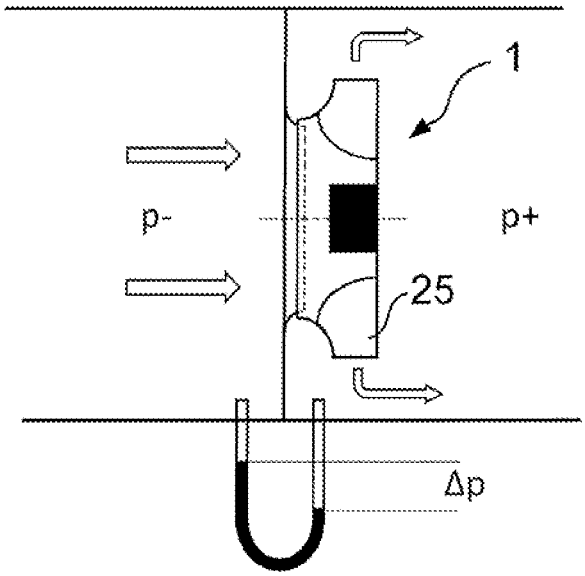
FIG. 1 is a schematic view illustrating the pressure difference generated by the fan.

FIG. 1 schematically shows an example of the pressure difference Δp generated in operation by a fan wheel 25 of the fan 1 and the intake-side negative pressure p− and the pressure side, that is, outflow-side positive pressure p+. In this case, the negative pressure p− is used to generate a suctioning of a cooling air flow that runs as a compensation flow against the main flow direction of the air flow generated by the fan wheel 25.

Figure 2:
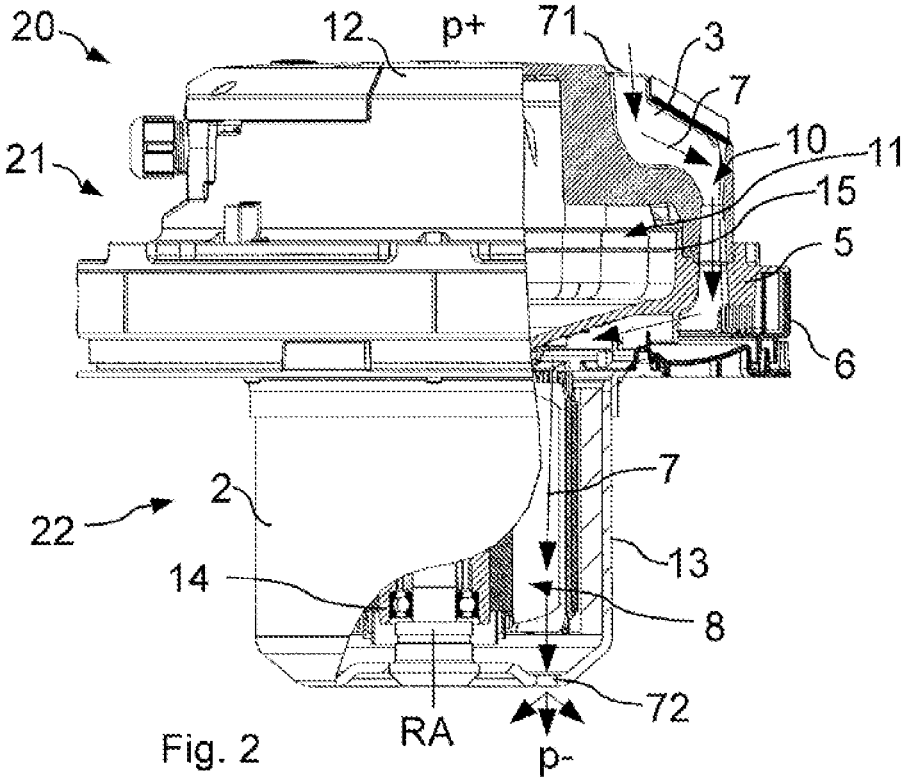
FIG. 2 is a perspective partially cross-section view of an exemplary embodiment of the external rotor motor designed for an axial, radial, or diagonal fan.

FIG. 2 shows a first exemplary embodiment of a partially cut-open external rotor motor 20 of the fan 1, designed as an axial fan. The overall arrangement of the external rotor motor 20 is axially divided into the electronics section 21 and the directly axially adjacent motor section 22. The motor electronics 11 is received in the lid-shaped electronics housing 12 in the electronics section 21. The motor drive components responsible for driving the fan wheel 25 (not shown here, but placed onto the rotor 2 in a manner shown in FIG. 3), particularly the cylindrical rotor 2 with its cup-shaped rotor housing 13 (rotor bell) and the stator pack 8 with motor windings received therein are accommodated in the motor section 22. The bearing 14 of the motor shaft is also visible.

The inflow opening 71 for the cooling air flow 7 is provided on the end face of the electronics housing 12. Axially and radially extending cooling fins 3 are provided starting from the inflow opening and define sections of duct wall surfaces of the cooling duct 10. The cooling duct 10 is continuous and runs in the radially outer portion of the external rotor motor. The cooling duct 10 is diverted radially outwards following the inflow opening 71 and past electronics components arranged on a circuit board 15 which define the motor electronics 11, then again diverted radially inwards to the rotor 2. In the region of the rotor 2, the cooling duct 10 runs axially straight inside the rotor housing 13 directly along the stator pack 8 and the bearing 14 to the outflow opening 72 on the axial end face. In the region of the rotor 2, the cooling duct is not specifically walled in the embodiment shown. Thus, the cooling air flow can freely flow along the path of lowest resistance along the motor components to the outflow opening 72. Alternatively, however, a cooling duct can be provided with a special guidance along specific components, that is formed as a closed duct by defined boundaries, for example the inner wall surface of the rotor housing.

In the region adjacent to the electronics section 21, stator cooling fins 5 distributed in the peripheral direction extend towards the rotor 2 in the motor section 22. The cooling duct 10 runs past the stator cooling fins 5. Thus, the cooling air flow 7 dissipates the heat absorbed by the stator cooling fins 5. The transition to the rotor 2 is closed by the cover 6. It is fastened to the electronics housing 12 and has a labyrinth shape to minimize pressure loss. Sections of the cover 6 form both a duct wall surface of the cooling duct 10 and an outer shell surface of the external rotor motor 20. When in operation, the cooling air flow 7 is suctioned in at the suction-side outflow opening 72 in the motor section 22, such that it flows into the inflow opening 71 on the pressure side and through the overall arrangement of the external rotor motor 20 to the outflow opening 72. Since the cooling air flow 7 is exclusively generated by the pressure difference between the suction side and the pressure side, it is in this case called passive.

Figure 3:
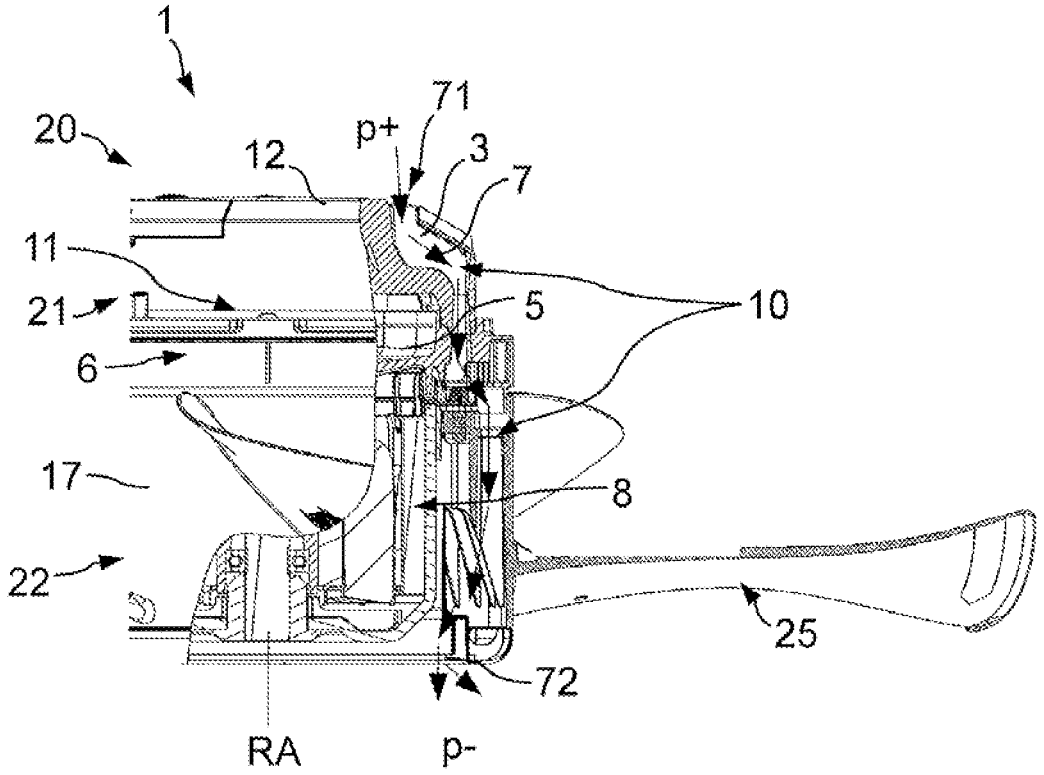
FIG. 3 is an elevation partially in cross-section view of an exemplary embodiment of the fan in an axial fan design.

FIG. 3 shows a side view of an exemplary embodiment of the fan 1 in an alternative design as an axial fan. The features described for the external rotor 20 from FIG. 1 are present here as well, unless explained otherwise. The fan wheel 25 is fastened to the rotor 2 such that its impeller hub completely encloses the rotor housing 13. In operation, the fan wheel 25 generates the main flow and also the pressure difference Δp used for the cooling air flow 7. In this embodiment, the outflow opening 72 is not provided at the rotor housing 13, but at the fan wheel 25 or its impeller hub, respectively. The cooling air flow 7 in the motor section 22 runs radially between the rotor housing 13 and the impeller hub 17 of the fan wheel 25. Thus, the cooling duct 10 is formed in the motor section 22 by the rotor housing 13 and the impeller hub of the fan wheel 25.

Figure 4:
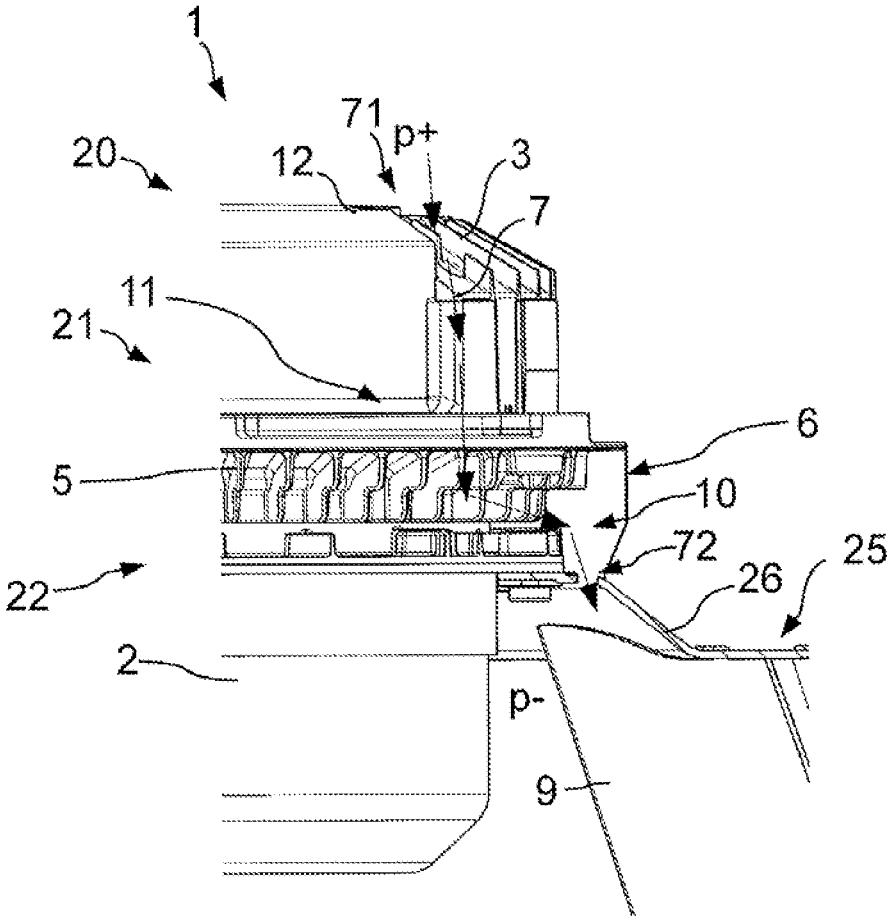
FIG. 4 is an elevation partially in cross-section of an exemplary embodiment of the fan in a radial fan design.

FIG. 4 shows an exemplary embodiment of the fan 1 in a design as a radial fan. The cooling duct 10, unlike in the preceding examples, is not conducted along the entire rotor 2. The fan wheel 25 of the radial fan has an outflow opening 72 in its impeller base plate 26. The impeller base plate 26 carries the impeller blades 9, which in the present embodiment are bent rearwards. The cooling duct 10 thus runs from the inflow opening 71 in the electronics housing 12 along the cooling fins 3 to the motor section 22 and therein along the stator cooling fins 5 radially outwards to the outflow opening 72 at the impeller base plate 26. The cooling air flow 7 is moved away to radially outwards by the fan wheel 25. The cooling in the electronics section 21 is identical with the preceding exemplary embodiments. Cooling in the motor section 22 is mainly performed via the stator cooling fins 5.

Figure 5:
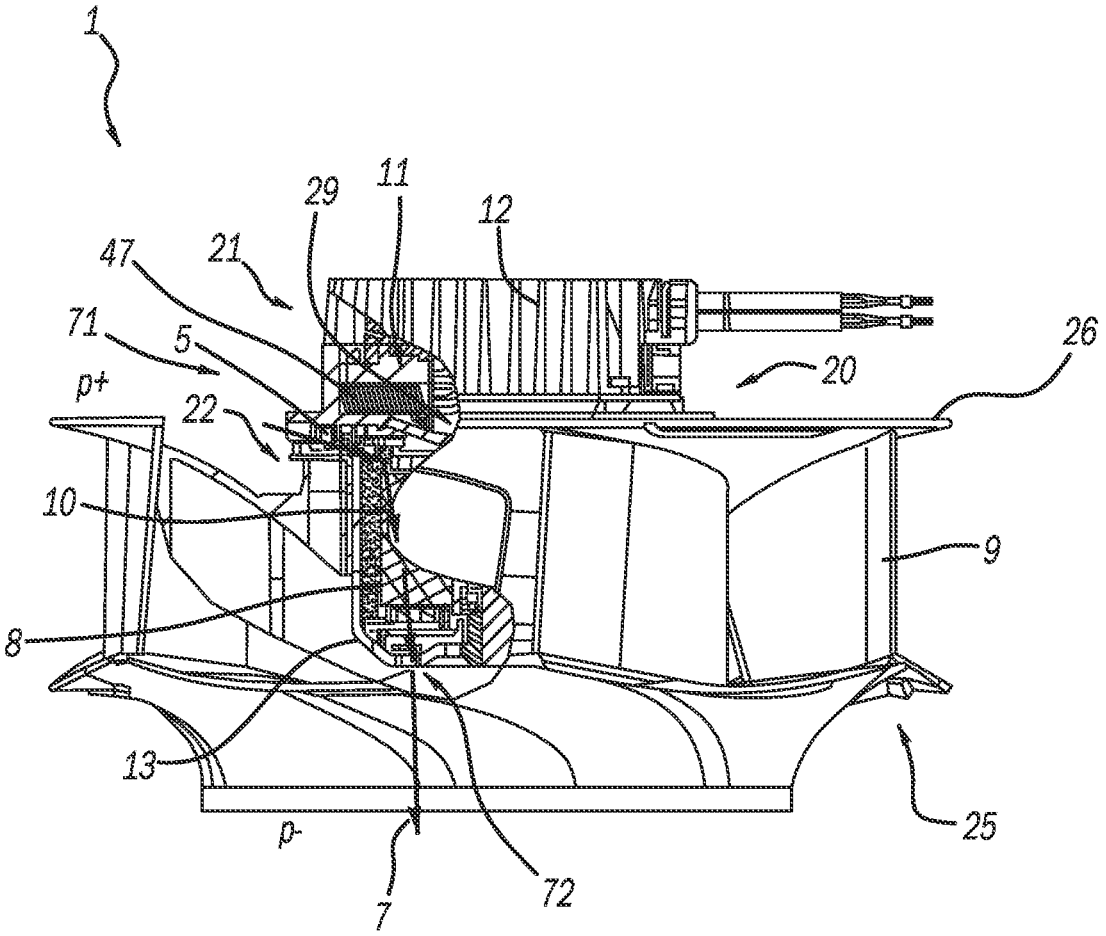
FIG. 5 is an elevation partially in cross-section of an alternative exemplary embodiment of the fan in a first variant.

FIG. 5 shows an alternative embodiment of the fan 1 in a design as a radial fan with the external rotor motor 20. Like the preceding exemplary embodiments, the motor section 22 and the electronics section 21 are axially adjacent along the axis of rotation RA with the motor electronics 11 arranged therein. All features identical with the preceding embodiments are not repeated, but they also apply to the exemplary embodiment according to FIG. 5. In an alternative embodiment not shown, the electronics section can also be oriented radially to the axis of rotation RA. The fan wheel 25 is received at the rotor 2 on the radial outside. The fan 1 generates a pressure difference Δp between its suction side and its pressure side by the fan wheel 25. Within the external rotor motor 20, the continuous cooling duct 10 runs from the pressure-side inflow opening 71 to the suction-side outflow opening 72 along the stator cooling fins 5. The cooling air flow 7 through the cooling duct 10, represented by arrows, is generated in operation exclusively passively by the pressure difference Δp generated by the fan wheel 25.

The power module 47 of the motor electronics 11 generates the most heat and is therefore directly arranged next to the stator bushing 29 which has the stator cooling fins 5 to cool the motor section 22 and the power module 47 of the motor electronics 11 by the stator bushing 29.

Figure 6:
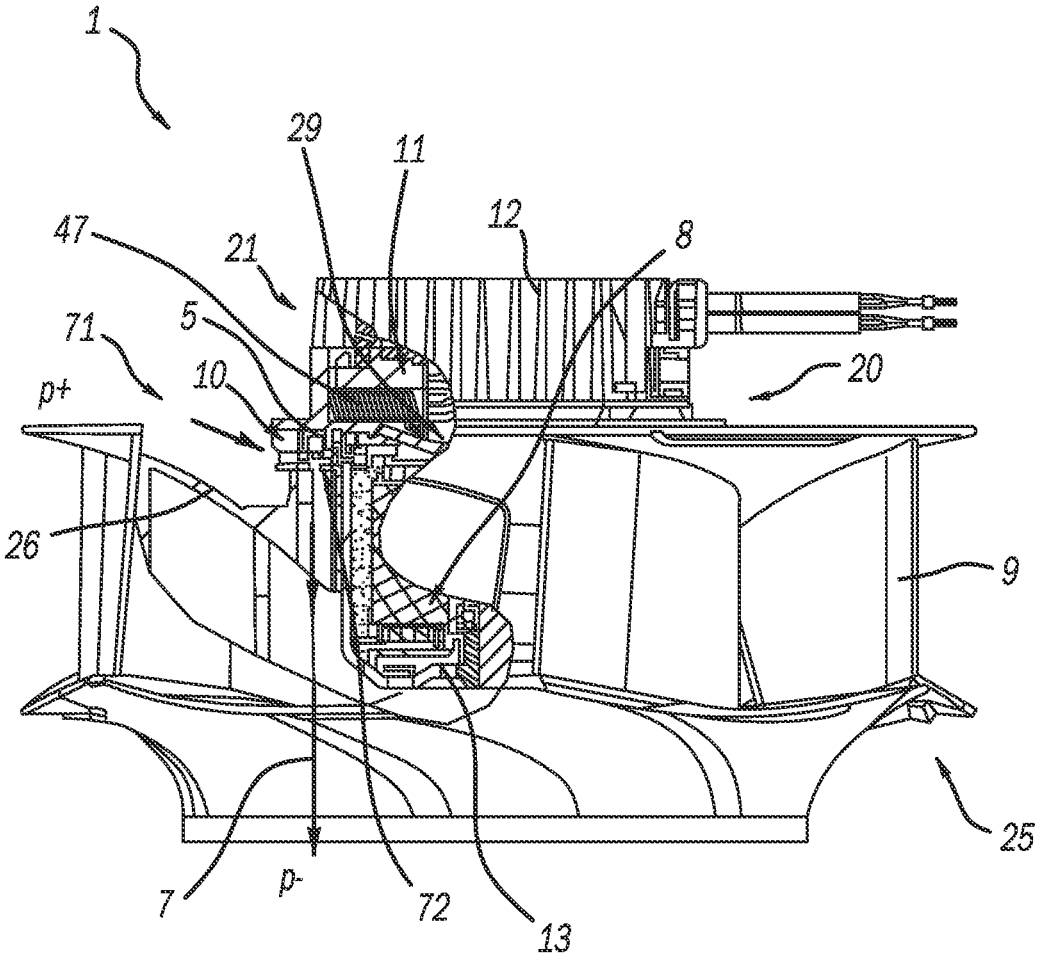
FIG. 6 is an elevation partially in cross-section view of an exemplary embodiment of another variant of the fan from FIG. 5.

FIG. 6 shows another exemplary embodiment of the fan 1, the structure of which is identical with that of FIG. 5, except for the following differences. The cooling air flow 7 remains outside the rotor 2 as in the embodiment according to FIG. 4. In this embodiment as well, the fan wheel 25 of the fan has the outflow opening 72 in the impeller base plate 26 that carries the rearward-bent impeller blades 9. The cooling duct 10 runs radially outside along the stator cooling fins 5 to the outflow opening 72 at the impeller base plate 26. The cooling air flow 7 is moved radially outwards by the fan wheel 25. Like in the embodiment according to FIG. 5, the fan 1 generates a pressure difference Δp between its suction side and its pressure side by the fan wheel 25. In operation, an exclusively passive cooling air flow 7, through the cooling duct 10, can be generated by the pressure difference Δp generated by the fan wheel 25. The power module 47 of the motor electronics 11 is also, in this embodiment, directly arranged next to the stator bushing 29 that has the stator cooling fins 5 to cool the motor section 22 and the power module 47 of the motor electronics 11 directly by the stator bushing 29. In the fan 1 according to FIG. 6, the electronics section can also be oriented or positioned radially rather than axially to the axis of rotation RA.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A fan having an external rotor motor comprising:

a rotor rotating about an axis of rotation in a motor section and configured to receive a fan wheel in an outwardly enclosing manner;

motor electronics are arranged in an electronic section and housed in an electronics housing, the motor section and the electronics section are arranged axially or radially adjacent to each other along the axis of rotation;

the fan generates a pressure difference (Δp) between its suction side and its pressure side by the fan wheel such that an air flow generated by the fan wheel flows in a first direction;

a continuous cooling duct runs inside the external rotor motor from a flow opening at the electronics housing along the motor electronics and at least along sections of the rotor to a flow opening in the motor section and an exclusively passive cooling air flow flowing in a second direction opposite to the first direction, through the cooling duct, can be generated in operation due to the pressure difference (Δp) generated by the fan wheel to cool both the electronics section and the motor section so that a negative pressure p− is used to generate a suctioning of a cooling air flow, in the second direction, that runs as a compensation flow against the first flow direction of the air flow generated by the fan wheel.

2. The fan according to claim 1, wherein the flow opening at the electronics housing defines a pressure-side inflow opening and the flow opening in the motor section defines a suction-side outflow opening.

3. The fan according to claim 2, wherein multiple cooling fins are formed on the electronics housing that extend axially and radially into the cooling duct starting from the inflow opening and form a duct wall surface of the cooling duct.

4. The fan according to claim 2, wherein the rotor comprises a rotor housing and the outflow opening is formed in a region of an axial end face of the rotor housing.

5. The fan according to claim 2, wherein the fan wheel comprises an impeller base plate with impeller blades wherein the base plate forms the outflow opening.

6. The fan according to claim 5, wherein the external rotor motor has, in the motor section, a stator bushing with a stator pack and motor windings as well as stator cooling fins which are distributed in a peripheral direction, the cooling duct runs along the stator cooling fins.

7. The fan according to claim 6, wherein the impeller base plate axially runs adjacent to the stator cooling fins that extend axially to the impeller base plate, such that the cooling air flow can be conducted axially via the stator cooling fins to the outflow opening in the impeller base plate.

8. The fan according to claim 1, wherein the external rotor motor has, in the motor section, a stator bushing with a stator pack and motor windings as well as stator cooling fins that are distributed in a peripheral direction, the cooling duct runs along the stator cooling fins and along the stator pack.

9. The fan according to claim 1, wherein the cooling duct is substantially closed at a transition from the electronics section to the motor section by a standing or rotatable unbladed cover.

10. The fan according to claim 1, wherein the cooling duct has multiple changes of direction in its course from the inflow opening to the outflow opening, such that the cooling air flow is diverted multiple times.

11. The fan according to claim 1, wherein the outflow opening is at an axial spacing from the fan wheel at the rotor.

12. The fan according to claim 1, wherein the cooling duct runs in a peripheral direction, locally limited to the electronics section and the motor section.

13. The fan according to claim 1, wherein the rotor is supported by at least one bearing and the cooling duct leads past the at least one bearing.

14. The fan according to claim 1, wherein the rotor is associated with the suction side and the motor electronics is associated with the pressure side.

15. A fan having an external rotor motor comprising:

a rotor rotating about an axis of rotation in a motor section and configured to receive a fan wheel in a radially outward enclosing manner;

motor electronics are arranged in an electronics section, the motor section and the electronics section are arranged axially or radially adjacent to each other along the axis of rotation;

the external rotor motor in the motor section comprises a stator bushing with a stator pack and motor windings as well as stator cooling fins which are distributed in a peripheral direction;

the fan, when operated as intended, generates a pressure difference between its suction side, on a first side of a housing, and its pressure side, on a second opposite side, of the housing, by the fan wheel such that an air flow generated by the fan wheel flows in a first direction from the suction side to the pressure side of the housing;

a continuous cooling duct runs inside the external rotor motor along the stator cooling fins from a pressure-side inflow opening, on the second opposite side, to a suction-side outflow opening, on the first side, and an exclusively passive cooling air flow flowing in a second direction opposite to the first direction, through the cooling duct, can be generated in operation due to the pressure difference generated by the fan wheel so that a negative pressure p− is used to generate a suctioning of a cooling airflow, in the second direction, that runs as a compensation flow against the first flow direction of the air flow generated by the fan wheel, at least one power module of the motor electronics is directly arranged next to the stator bushing which has the stator cooling fins to cool the motor section and at least the power module of the motor electronics by means of the stator bushing.

* * * * *